US008023836B2

(12) United States Patent
Dawson

(10) Patent No.: US 8,023,836 B2
(45) Date of Patent: Sep. 20, 2011

(54) SUPPLY ITEM FOR LASER PRINTER INCLUDING KEYING STRUCTURE

(75) Inventor: Jedediah T. Dawson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/335,699

(22) Filed: Dec. 16, 2008

(65) Prior Publication Data

US 2010/0295907 A1 Nov. 25, 2010

Related U.S. Application Data

(62) Division of application No. 11/388,848, filed on Mar. 24, 2006, now Pat. No. 7,813,656, and a division of application No. 12/335,655, filed on Dec. 16, 2008.

(51) Int. Cl.
*G03G 15/00* (2006.01)
*G03G 21/18* (2006.01)

(52) U.S. Cl. ..... 399/12; 399/112

(58) Field of Classification Search ..... 399/12, 399/112

See application file for complete search history.

(56) References Cited

U.S. PATENT DOCUMENTS

| | | | | |
|---|---|---|---|---|
| 4,740,808 | A | 4/1988 | Kasamura et al. | |
| 4,885,611 | A | 12/1989 | Higashio et al. | |
| 6,023,594 | A | 2/2000 | Okiyama et al. | |
| 6,505,006 | B1 | 1/2003 | Solanki et al. | |
| 6,589,704 | B2 | 7/2003 | Jensen et al. | |
| 6,600,881 | B2 | 7/2003 | Cornelius | |
| 7,130,558 | B2 | 10/2006 | Matsumoto et al. | |
| 2003/0184624 | A1 * | 10/2003 | Kinalski | 347/86 |
| 2010/0183319 | A1 | 7/2010 | Dawson et al. | |

FOREIGN PATENT DOCUMENTS

| | | | |
|---|---|---|---|
| JP | 63-075769 | A | 4/1988 |
| JP | 2003005501 | A * | 1/2003 |

OTHER PUBLICATIONS

Prosecution history of copending U.S. Appl. No. 12/335,655 including non-final Office Action dated Jun. 23, 2010 and response filed Nov. 18, 2010.

(Continued)

*Primary Examiner* — David Gray
*Assistant Examiner* — Erika J Villaluna
(74) *Attorney, Agent, or Firm* — John Victor Pezdek; Justin M. Tromp

(57) ABSTRACT

Supply items, such as toner bottles for laser printers, include substantially identical housings amongst the many different colors of toners. To distinguish the items and prevent improper installation, a keying structure attaches per each bottle and is indexed relative to adjacent items. In one aspect, indexing includes rotating a knob of the keying structure about a central axis to provide different keying orientations to an imaging unit in the printer. During installation, users mate the knob with variously arranged channels in a wall defining a slot for receiving the bottles. A lengthy flange on the bottle mates with a lengthy slit of the wall to provide installation stability. Other embodiments contemplate delaying engagement of a shutter on the bottle that prevents the toner from communicating with the imaging unit until the mating of the keying structure is assuredly made relatively proper. This prevents inadvertent mixing of toner colors.

6 Claims, 7 Drawing Sheets

OTHER PUBLICATIONS

Prosecution history of parent U.S. Appl. No. 11/388,848 (now issued as US Patent No. 7,813,656) including non-final Office Action dated Jan. 26, 2009 and response filed Apr. 27, 2009, final Office Action dated Aug. 20, 2009 and amendment after final filed Oct. 1, 2009, advisory action dated Nov. 18, 2009 and amendment after final filed Nov. 20, 2009, advisory action dated Dec. 14, 2009 and amendment after final filed Dec. 17, 2009, notice of allowance dated Feb. 23, 2010, and issue notification dated Sep. 22, 2010.

PCT International Search Report and Written Opinion of the ISA for PCT Application No. PCT/US07/07318 (attached—9 pages).

Final Office Action dated Mar. 31, 2011 for copending U.S. Appl. No. 12/335,655 and response filed May 26, 2011.

* cited by examiner

SUPPLY ITEM FOR LASER PRINTER INCLUDING KEYING STRUCTURE

CROSS REFERENCE TO RELATED APPLICATIONS

Pursuant to 37 C.F.R. §1.78, this application is a divisional and claims the benefit of the earlier filing date of application Ser. No. 11/388,848, filed Mar. 24, 2006 now U.S. Pat. No. 7,813,656, entitled "Supply Item for Laser Printer including Keying Structure." This application is also related to divisional application Ser. No. 12/335,655, filed Dec. 16, 2008, entitled "Supply Item for Laser Printer including Keying Structure."

FIELD OF THE INVENTION

Generally, the present invention relates to laser printers. Particularly, it relates to original, replaceable or refillable supply items, such as toner bottles, and their location or placement in the printer. In one aspect, mechanical keying structures are contemplated to prevent various supply items from being improperly installed. In another aspect, supplying toner from supply items is delayed pending proper location of the supply item. Still other aspects relate to stabilizing the supply item during user (re)placement.

BACKGROUND OF THE INVENTION

Supply items for laser printers are regularly replaced during printer lifetime. However, to relatively ensure their proper placement, varieties of schemes have been introduced. For example, some laser toner cartridges include a series of tabs molded on a cartridge housing. Depending whether the cartridge includes cyan, magenta or yellow colored toner, patterns of tabs are broken off that allow mating with corresponding patterns of slots in the printer. If users attempt to improperly seat or load a cartridge in the wrong position, the unbroken or remaining tabs interfere with the pattern of slots and insertion is prevented. While approaches like these fairly accomplish the task of minimizing improper loading, their manufacturing process adds steps for marking break-off patterns and requires extra tools, and spacing, to grasp and break the tabs according to the pattern. Broken tabs also add material costs for they are routinely discarded. Ergonomically, molding residue with broken tabs is unsightly and tends to require a relatively large profile.

In other designs, pattern-mating cartridges and printer slots are such that users can insert wrongly colored cartridges a fair distance before mechanical lockout or insertion prevention occurs. Because the distance is sometimes lengthy, the toner of the supply item may have already inadvertently mixed with imaging components relating to a different colored toner. Intuitively, this causes messiness and poor color registration. Still other designs leave to users the actuation of mixing toner of supply items with imaging components. Because of human imperfection, users sometimes inadvertently begin toner mixing before it is assured that the supply item is properly located in a given color slot or properly seated. This too can cause messiness or poor color registration.

Accordingly, there exist needs in the art for simplifying supply item manufacturing (original or refilled) and installing same. Naturally, any improvements should further contemplate good engineering practices, such as relative inexpensiveness, mechanical stability, low complexity, etc.

SUMMARY OF THE INVENTION

The above-mentioned and other problems become solved by applying the principles and teachings associated with the hereinafter described supply item for a laser printer including a keying structure. Specifically, methods and apparatus for manufacturing (original or refilled) supply items for a laser printer and inserting same in printers for use are hereafter described. This includes simple mechanical keying structures of nearly identical size and shape that, upon various orientations at a single location of attachment to a supply item, serve to readily identify different colored toner bottles during manufacturing, sale and use and prevent the improper location or seating of the supply item in the printer. Further, supplying toner from the bottles to imaging components is delayed pending proper location of the supply item. Self actuating components for performing the supplying are also contemplated. Still other aspects relate to stabilizing the supply item during user (re)placement.

In this regard, supply items for laser printers, such as toner bottles, include substantially identical housings amongst the many different colors of toners. In this manner, all bottles regardless of color have commonality during molding and manufacturing is simplified. To distinguish the items and prevent improper installation, a keying structure attaches per each bottle at the same location and is indexed relative to adjacent items. In one aspect, attachment includes inserting a screw, snap, rivet, bolt or other fastener into a hole of the keying structure at a central axis thereof. In turn, indexing the keying structure from one colored toner bottle to the next includes rotating a knob of the keying structure about the central axis to provide different keying orientations to an imaging unit in the printer. Preferred orientations relate to one of three positions of the knob about 120 degrees apart from other positions. During installation, users mate the knob with variously arranged channels in a wall of the imaging unit defining a slot that receives the bottles. To provide stability, a lengthy flange on the bottle mates with a lengthy slit of the wall and both cooperate guide the bottle into proper location. Upon nearly fully seating the bottle in its respective slot, and after or during mating of the knob of the keying structure with the wall, various surfaces engage one another to open a shutter on the bottle that otherwise retains the toner in the bottle and prevents it from communicating with the imaging unit. In this manner, self-actuation is attained and delayed engagement of the shutter assuredly prevents inadvertent color mixing or shutter opening until proper seating is relatively assured.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical and/or other changes may be made without departing from the scope of the present invention. In accordance with the present invention, supply items for laser printers including keying structures are hereafter described.

Figure 1:
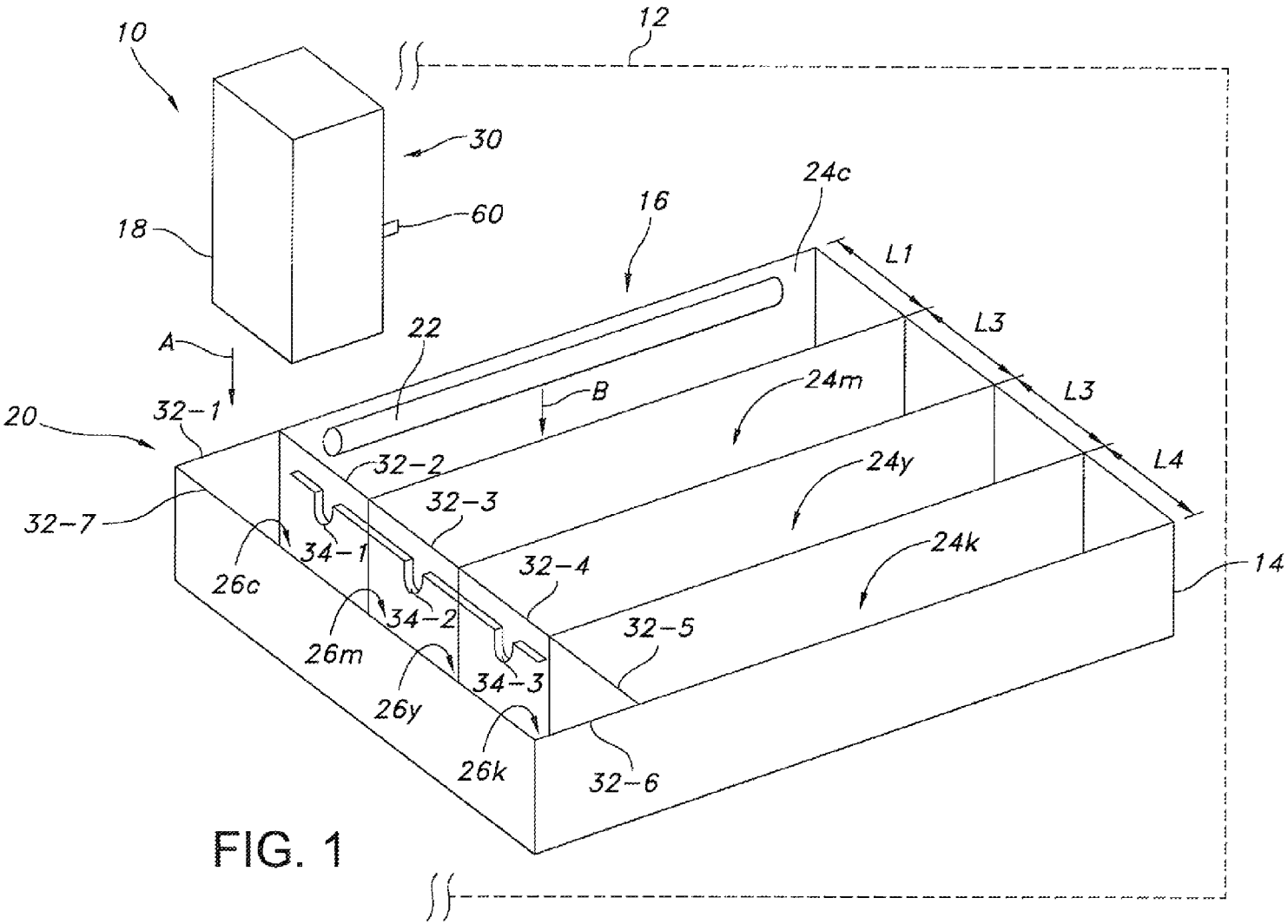
FIG. 1 is a diagrammatic view in accordance with the present invention of a representative supply item having keying structures for position-discriminated use in a laser printer.

With reference to FIG. 1, a supply item of the invention is given generically as 10. It includes a housing 18 with an interior for holding an initial or refillable supply of toner, especially cyan, magenta, yellow or black, for use (via insertion in the direction of arrow A) in a laser printer shown generically by the dashed line 12. An imaging unit 14 includes a first section 16 and a second section 20. The first section houses a plurality of imaging components, generically an electrophotographic drum 22 shown inserted in the direction of arrow B, for applying toner to a substrate or other media (not shown) as the substrate passes by the components during use. Adjacently, the first section also includes a plurality of like compartments 24*c*, 24*m*, 24*y*, 24*k* for containing the components that apply the toner for respective colors cyan, magenta, yellow and black. Of course, the process for applying toner to media is well known and not discussed further herein.

In the second section 20, pluralities of slots 26*c*, 26*m*, 26*y* and 26*k* are provided for seating or receiving a supply item (one per slot), such as a toner bottle containing cyan, magenta, yellow and black toner, respectively. Once installed, or seated, the supply items communicate with and supply toner to the imaging unit, especially the components of the first section, for application to a substrate. To ensure proper installation or seating of the toner bottles per the appropriate color slot, the housing 18 includes a keying structure 30 that mates with an appropriate structure in the imaging unit. In a representative embodiment, pluralities of walls 32 serve to define the slots 26. Also, the walls include attached, notched, scored or otherwise formed channels 34 that receive the keying structure 30 of the supply item. By variously positioning the channels, the supply items are properly keyed. As shown, the channels 34-1, 34-2, and 34-3 are offset toward a right end (as oriented in the figure upright for reading), a middle or a left end of the walls 32-2, 32-3, and 32-4, respectively. For the slot 26*k* for the black toner supply item, no channel is necessary because keying, if you will, is obtainable by making the slot different dimensions. Preferably, its slot is longer L4 as compared to slot lengths L1, L2, and L3 for the other slots 26*c*, 26*m* and 26*y*, respectively. Naturally, the wall 32-5 could also have a channel as do the other walls, if desired. By not having a channel, however, simplicity is achieved.

Figure 2:
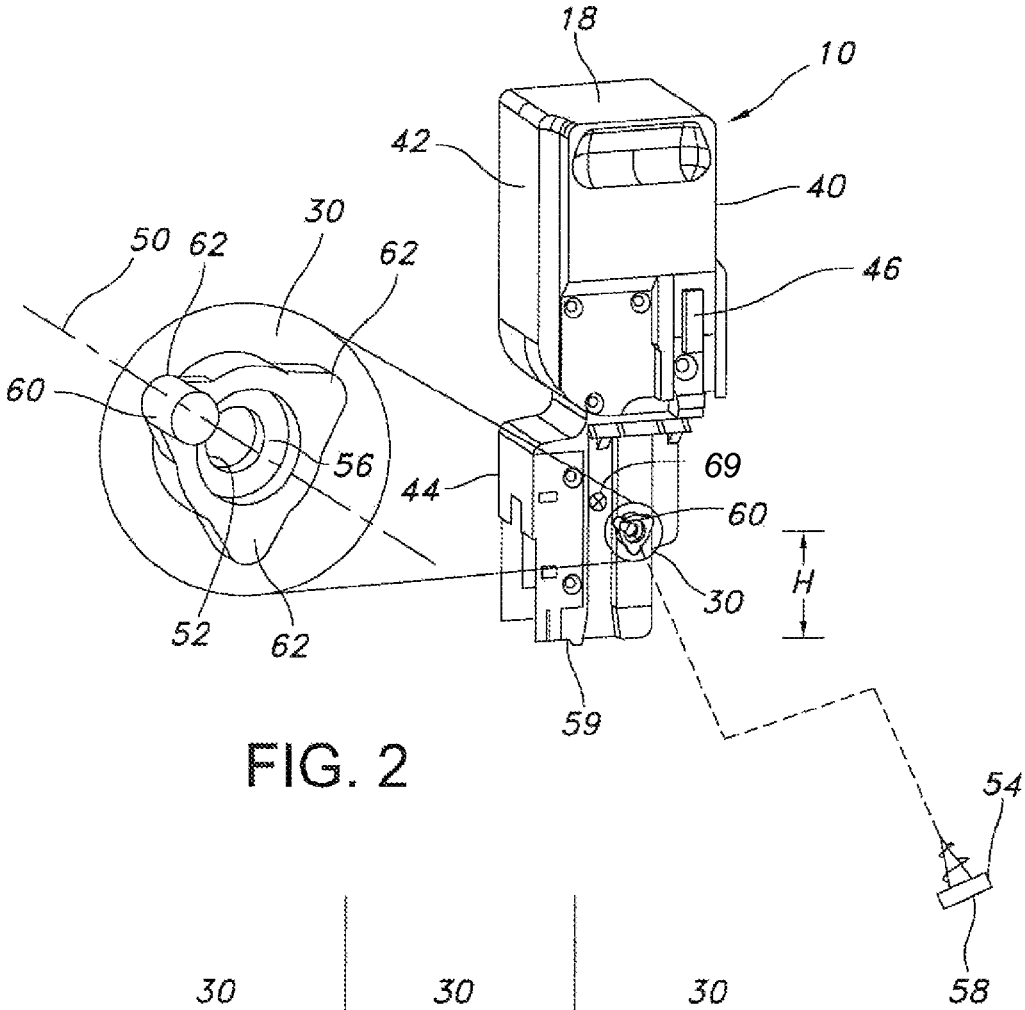
FIG. 2 is a diagrammatic view in accordance with the present invention of a supply item having a representative keying structure.

With reference to FIG. 2, a representative supply item 10 of the invention includes a toner bottle 40 with an upper portion 42 and a lower portion 44. During use, the upper portion is originally or refilled with a colored toner for communication with the imaging unit to apply toner to a substrate while the lower portion 44 is a sump, of sorts, to receive waste toner from the imaging unit. In this regard, various gears, paddles, drives, and the like (not shown) are provided in an interior of the housing 18. A shutter 46 serving as a door to retain the toner in the upper portion 42 is also provided that will open, as described below in FIG. 9 as a delayed engagement, of sorts, upon proper seating of the toner bottle in a slot 26 of the imaging unit 14. Once seated, it will communicate and supply toner to the imaging unit for use.

As before, a keying structure 30 is attached to the toner bottle to mate with a wall channel to properly seat in the imaging unit. In a representative embodiment, the keying structure 30 includes a central axis 50 defined by a circular hole 52. During use, a mechanical fastener 54, such as a screw, bolt, rivet, snap, or the like fits in the hole and secures or attaches the keying structure to the housing 18. A recess 56 in a thickness of the keying structure may optionally be provided to make a head 58 of the fastener 54 flush with the keying structure. Alternatively, the keying structure is attached to the housing 18 via an adhesive, such as an epoxy. In either, the keying structure 30 is placed at a single, consistent location on all bottles and is representatively given at a height H of about a few inches from a bottom 59 of the toner bottle. Its height is variable but representatively selected such that it adds mechanical stability to the toner bottle position in a slot of the imaging unit upon its full seating in the imaging unit.

Figures 3A, 3B, 3C:
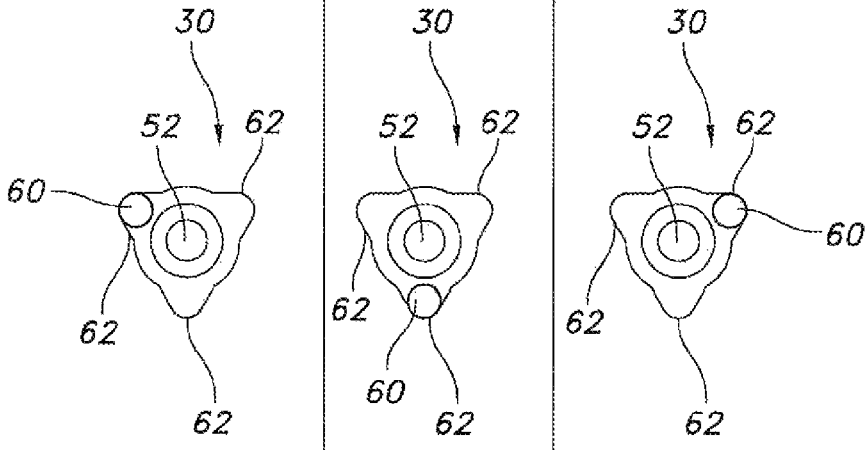
FIGS. 3A-3C are diagrammatic views in accordance with the present invention of operational positions of the keying structure of FIG. 2.

A knob 60, on one of a variety of lobes 62, also forms a portion of the keying structure. It is preferably found at one of three operational positions on the toner bottle to give various orientations to the supply item for mating with wall channels 34 (FIG. 1) depending upon the color of toner in the bottle. In FIGS. 3A-3C, the knob 60 is representatively found in an upper left hand lobe, a bottom lobe or an upper right hand lobe of the keying structure as viewed in the Figure in an upright orientation for reading. In this regard, three distinct positions are given that can correspond to three toner bottles each containing one of cyan, magenta or yellow toner. Also, its positioning on the toner bottle is accomplished simply by attaching the keying structure to the bottle with the mechanical fastener and rotating or indexing the knob about its central axis. Preferably, this is done in 120 degree increments. Naturally, more positions would require fewer degrees between positions, and vice versa. During use, it is then expected that one toner bottle will have a knob oriented as in FIG. 3A, an adjacent toner bottle will have a knob oriented as in FIG. 3B and still another toner bottle with a knob oriented as in FIG. 3C.

In any orientation, certain advantages of the invention over the prior art are readily apparent. For example, all toner bottles of the invention can be manufactured substantially identically to any other toner bottle. This adds robustness and tends to lower manufacturing costs. More intuitively, because tabs are not broken off the bottles, material is not wasted by discarding broken tabs and no special tooling, and attendant spacing, is required to place the keying structure on the bottle.

Sight ergonomics are improved because no molding residue remains with broken tab spaces. Profile ergonomics are improved because the keying structure is relative thin. Manufacturability is further easily accomplished by simply aligning the knob to visual or mechanical reference indicia 69 on the toner bottle according to the desired orientation of the toner bottle.

Figure 4:
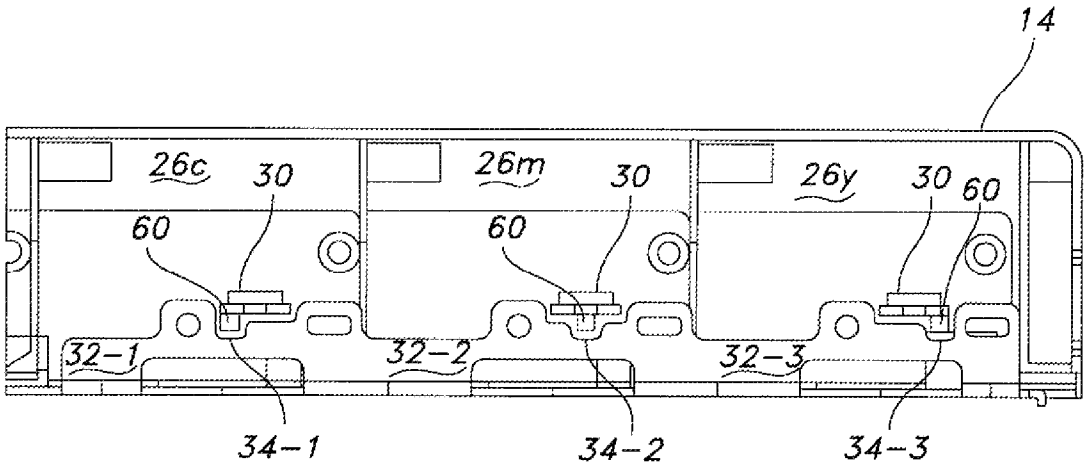
FIG. 4 is a partial diagrammatic view in accordance with the present invention of the keying structures in various orientations in a laser printer.
Figure 5B:
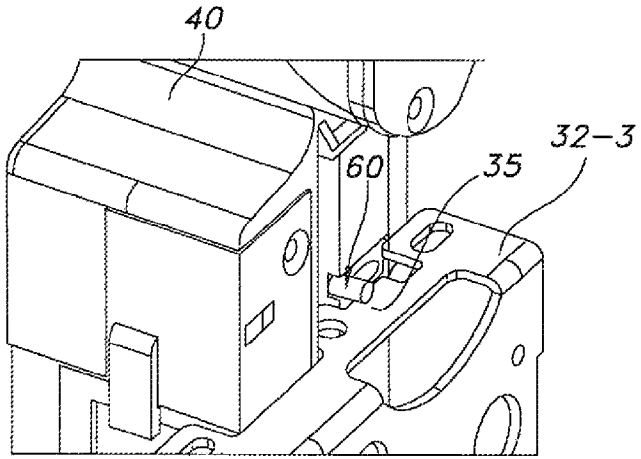
FIGS. 5A and 5B are diagrammatic views in accordance with the present invention of keying structures of a supply item being inserted into a proper representative orientation in a laser printer and being prevented from improper insertion.
Figure 5A:
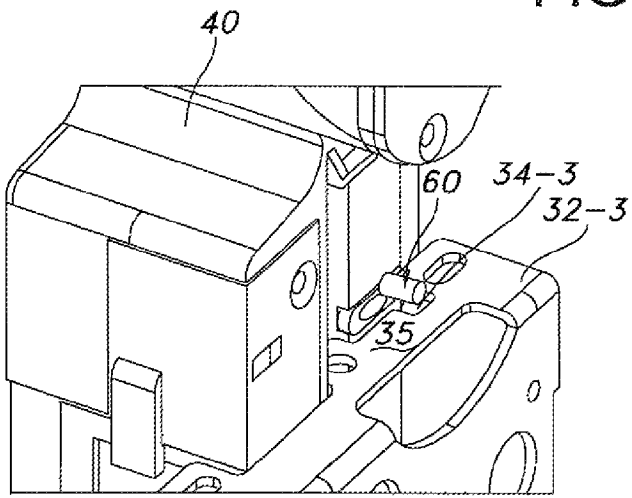

With reference to FIG. 4, skilled artisans can observe the effects of the different positions of the knob 60 of the keying structure 30 in a pseudo top view of the toner bottles mated to a channel 34 in a wall 32 of an imaging unit. That is, the positions of the knobs 60 in FIGS. 3A-3C are representatively seen adjacently in an imaging unit in FIG. 4. The channels 34-1, 34-2 and 34-3 in each of the walls 32-1, 32-2 and 32-3 of the imaging unit are arranged left, middle and right, so to speak, to correspond to the positions of FIGS. 3A-3C, respectively. In perspective view, FIGS. 5A and 5B show the knob 60 being both properly inserted or mated with a various channel 34-3 of the wall 32-3 of the imaging unit and improperly inserted, respectively. Namely, skilled artisans will observe the knob 60 passing cleanly or in an unobstructed fashion into the channel 34-3 in FIG. 5A whereas the knob 60 is attempted to be inserted into a wrongly colored slot of the imaging unit in FIG. 5B and is impeded by the wall bulk 35. As a result, the toner bottle is allowed to fit into the appropriate slots of the imaging unit and prevented from being inserted into the wrong slots having the wrong colored toner components. Also, skilled artisans will appreciate that the keying structure and knob must have sufficient sturdiness and thickness to pass properly into a wall channel and, when being impeded, being fairly prevented from insertion despite a certain amount of force being applied by users attempting to wrongly insert the toner bottle. In this regard, the composition of the keying structure is representatively plastic including a thickness of about $1/10^{th}$ of an inch and a width from lobe to lobe of about ½ inches. The knob, on the other hand, is roughly cylindrical with a radius of about $1/8^{th}$ of an inch and a depth of about $1/8^{th}$ of an inch. The knob 60 may also have other configurations including having one or more flat surfaces as shown in FIG. 8.

Figure 6:
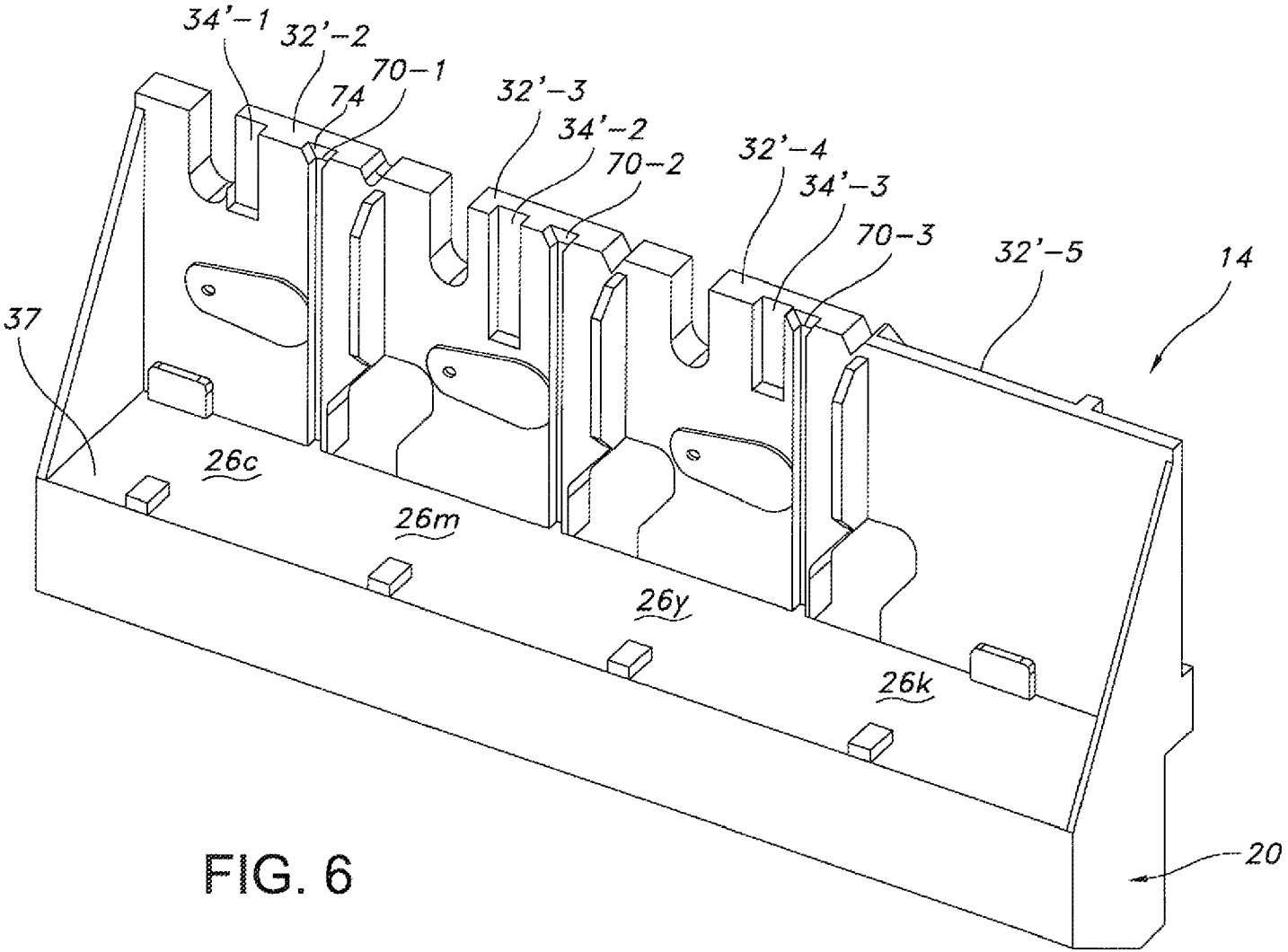
FIG. 6 is a diagrammatic perspective view in accordance with the present invention of representative walls defining slots for receiving supply items in a laser printer.
Figure 7:
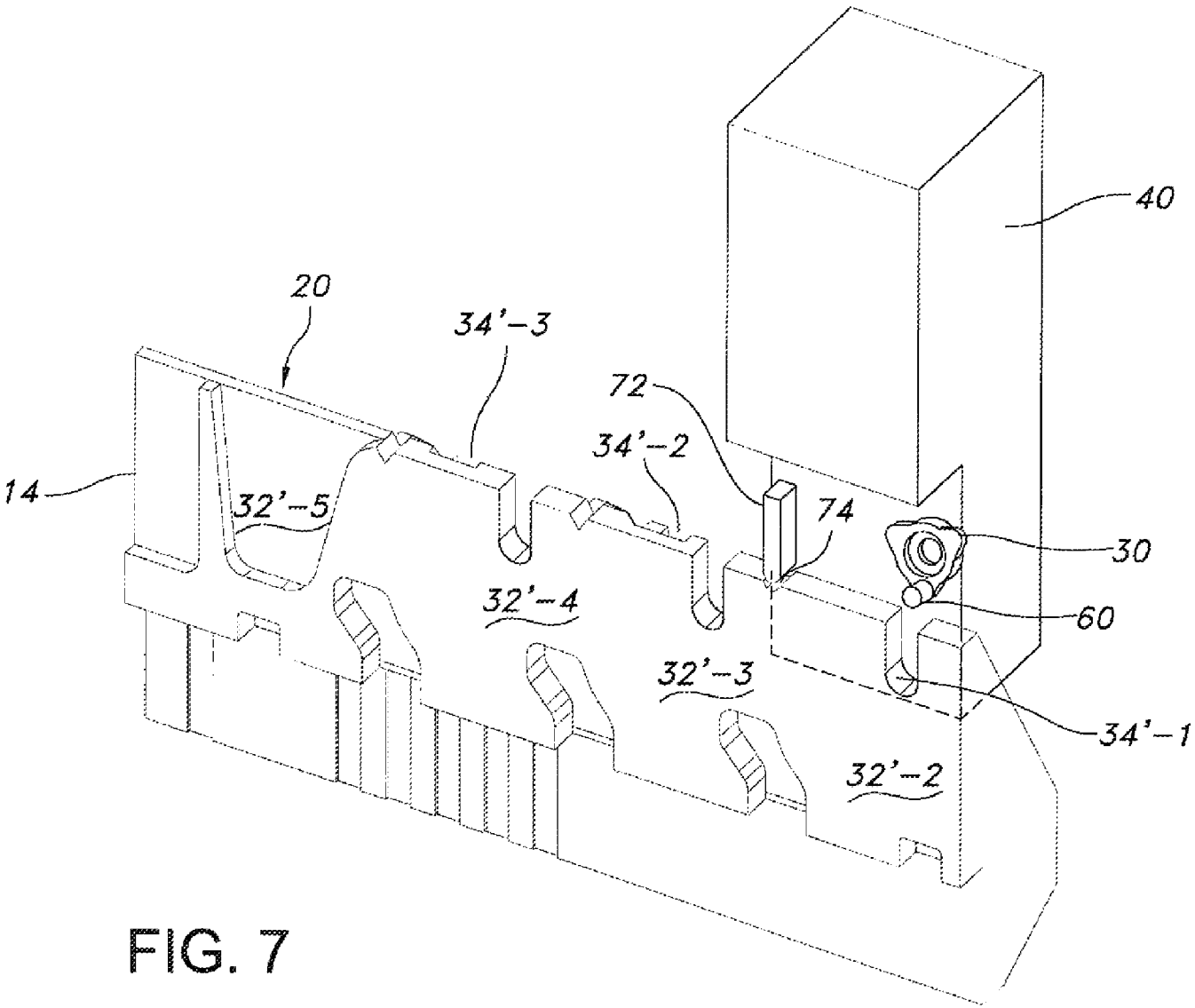
FIG. 7 is a diagrammatic perspective view in accordance with the present invention of a backside of the walls of FIG. 6 including a to be mated keying structure of a supply item.
Figure 8:
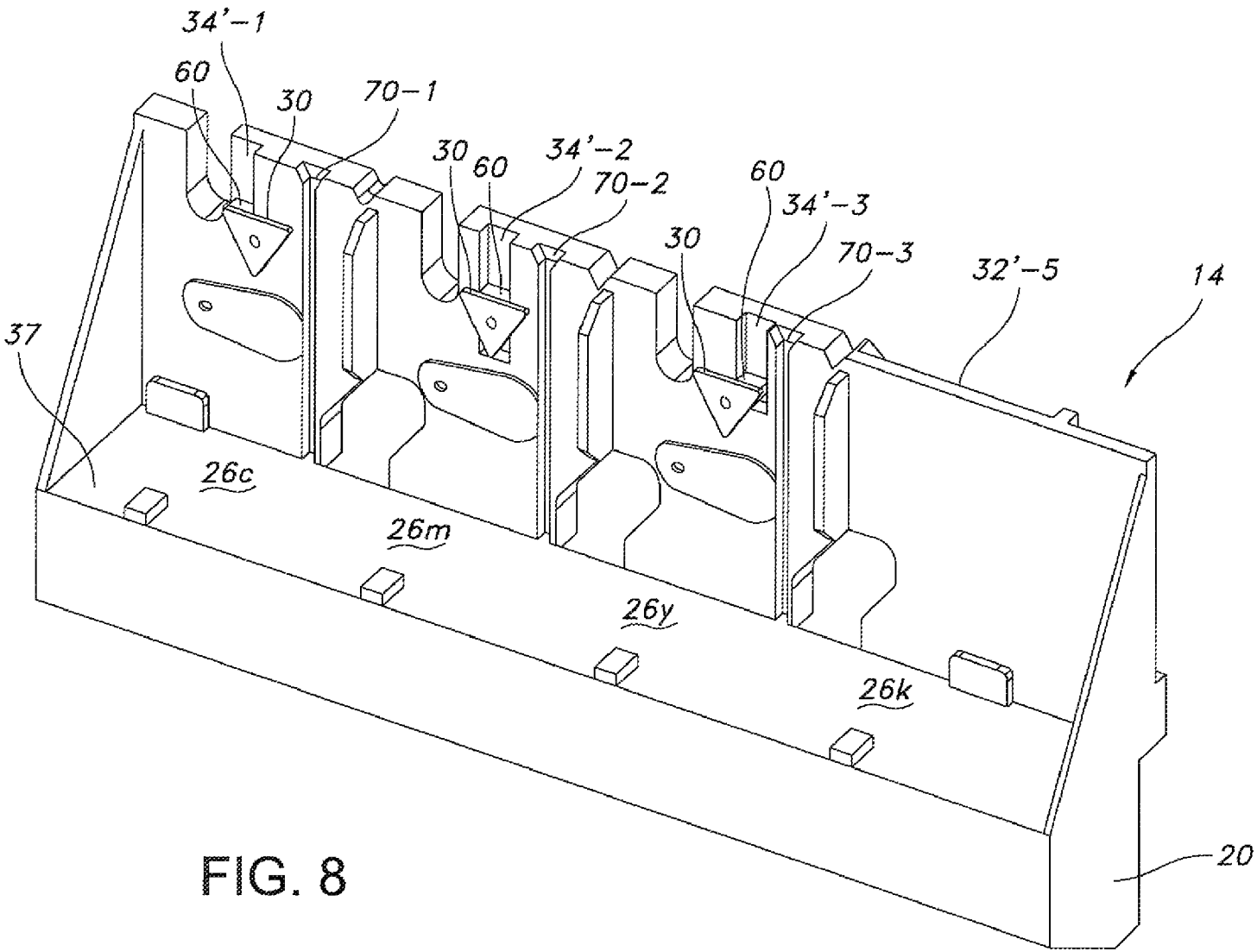
FIG. 8 is a diagrammatic perspective view in accordance with the present invention of the walls of FIG. 6 including the keying features being disposed therein.

In FIGS. 6, 7 and 8, an alternate embodiment of a portion of the second section 20 of the imaging unit 14 includes slots 26*c*, 26*m*, 26*y* and 26*k* for receiving appropriately colored toner bottles being defined, in part, by walls 32'-2, 32'-3, 32'-4 and 32'-5 and a floor 37. As before, channels 34'-1, 34'-2 and 34'-3 in the walls serve to receive the knob 60 of a keying structure 30 of a toner bottle, especially according the positions of the knob in FIGS. 3A-3C, to accommodate the various orientations of the toner bottles, especially according to color. In addition, the walls include slits 70-1, 70-2, and 70-3 each having a relative length longer than a relative length of the channels for receiving the knobs of the keying structure. The reason for the slits is to provide mechanical stability for the insertion operation of the toner bottle. That is, a corresponding lengthy flange 72 attached or formed in the toner bottle 40 mates with the slits 70-1, 70-2, and 70-3 during insertion and helps guide the toner bottle into position. A relatively wide neck 74 may also form a portion of the slits 70-1, 70-2, and 70-3 to assist in starting the flange of the bottle into its respective slot. Because of the relative lengths of the slits 70-1, 70-2, and 70-3 versus the channels 34, skilled artisans will appreciate that the flange is first started in the slit and after a certain amount of insertion, the knob of the keying structure will engage or slide in the channel and be seated therein. In this manner, once seated, both the flange and the keying structure provide mechanical stability during use.

Figure 9:
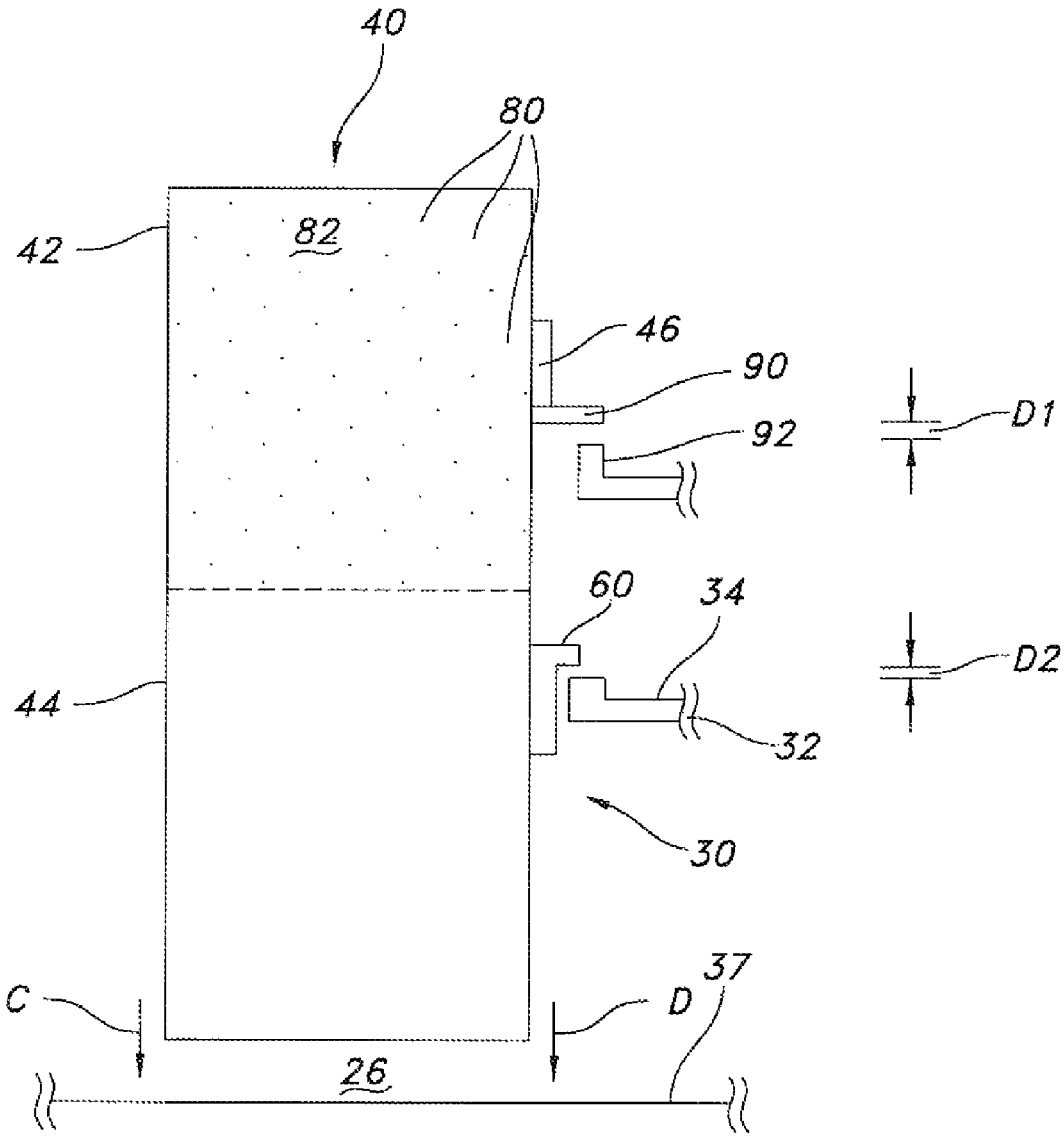
FIG. 9 is a diagrammatic view in accordance with the present invention of a supply item including a keying structure and shutter for engagement during use.

In still another embodiment, FIG. 9 shows the delayed engagement aspect of the shutter 46 that retains original or refilled toner 80 in an interior 82 of the housing 18 of the toner bottle 40. That is, upon insertion of the toner bottle 40 in the direction of arrows C and D into a slot 26 of the imaging unit, the knob 60 of the keying structure 30 eventually engages the channel 34 of a wall 32 as previously described. If located properly, the knob seats and the toner bottle continues being inserted until its bottom 59 rests on the floor 37. A lever 90 of the shutter 46, however, is positioned sufficiently such that upon the knob 60 first passing into the channel 34, or shortly thereafter, a corresponding projection 92 of the imaging unit engages the lever 90 and opens the shutter from a slight crack to fully open as the toner bottle becomes seated. As a result, the shutter, and the toner communication with the imaging unit, is made self actuating. In turn, inadvertent toner spills and mixing of different colored toners is substantially prevented. Also, the shutter is delayed from being engaged until such time as it is relatively assured that the toner bottle is properly keyed or mated with the imaging unit. For example, if the toner bottle were being inserted into an inappropriate slot in the imaging unit, the wall bulk 35 (FIGS. 5A and 5B) would prevent further insertion of the toner bottle. Upon this occurring, the lever 90 of the shutter would not yet have engaged the projection 92 of the imaging unit and the shutter 46 would remain closed. The maintenance of distances D1>D2 or D1>>D2, for instance, conveniently accomplishes this task.

Finally, one of ordinary skill in the art will recognize that additional embodiments are also possible without departing from the teachings of the present invention. This detailed description, and particularly the specific details of the exemplary embodiments disclosed herein, is given primarily for clarity of understanding, and no unnecessary limitations are to be imparted, for modifications will become obvious to those skilled in the art upon reading this disclosure and may be made without departing from the spirit or scope of the invention. Relatively apparent modifications, of course, include combining the various features of one or more figures with the features of one or more of other figures.

What is claimed:

1. A laser printer, comprising:

a plurality of bottles of toner each with a housing substantially identical to the other bottles; and a keying structure attached per said each bottle at substantially the same location on each bottle, each keying structure indexed relative to the keying structure of an adjacent one of said bottles, each keying structure including three lobes, one of said lobes including a knob.

2. The laser printer of claim 1, wherein said keying structure is polygonal in shape.

3. The laser printer of claim 2, wherein said keying structure is triangular.

4. The laser printer of claim 2, wherein said knob has at least one flat surface.

5. The laser printer of claim 1, further comprising a reference indicia on said housing of each bottle for aligning said keying structure.

6. The laser printer of claim 1, further comprising each keying structure including a mechanical fastener hole at a central axis of said keying structure and a mechanical fastener extending through each mechanical fastener hole and attaching each keying structure to one of said bottles.

* * * * *